US006608599B2

(12) United States Patent
Chen et al.

(10) Patent No.: US 6,608,599 B2
(45) Date of Patent: Aug. 19, 2003

(54) PRINTED CONDUCTIVE MESH DIPOLE ANTENNA AND METHOD

(75) Inventors: Fu-Chiarng Chen, San Diego, CA (US); Allen Tran, San Diego, CA (US)

(73) Assignee: Qualcomm, Incorporated, San Diego, CA (US)

( * ) Notice: Subject to any disclaimer, the term of this patent is extended or adjusted under 35 U.S.C. 154(b) by 0 days.

(21) Appl. No.: 10/044,193

(22) Filed: Oct. 26, 2001

(65) Prior Publication Data

US 2003/0080903 A1 May 1, 2003

(51) Int. Cl.[7] ..... H01Q 9/28
(52) U.S. Cl. ..... 343/795; 343/801; 343/813
(58) Field of Search ..... 343/793, 795, 343/801, 812, 813; H01Q 9/28

(56) References Cited

U.S. PATENT DOCUMENTS 4,342,035 A * 7/1982 Anderson et al. ..... 343/792.5
4,975,713 A * 12/1990 Sheriff ..... 343/795
5,159,347 A * 10/1992 Osterwalder ..... 343/787
6,198,457 B1 * 3/2001 Walker et al. ..... 343/840
6,259,408 B1 * 7/2001 Brady et al. ..... 343/700 MS
6,329,955 B1 * 12/2001 McLean et al. ..... 343/742

* cited by examiner

*Primary Examiner*—Tho Phan
(74) *Attorney, Agent, or Firm*—Philip R. Wadsworth; Charles D. Brown; Howard H. Seo

(57) ABSTRACT

A printed conductive mesh dipole antenna, and a method of use of the antenna. The printed dipole antenna includes a dielectric substrate 12 and a conductive mesh 14 formed of a plurality of symmetric shapes 18 printed on the dielectric substrate. Each of the symmetric shapes is coupled to at least one other of the shapes, and placed periodically on the dielectric substrate proximate to at least one other of the shapes. The periodic placement of the shapes forms a symmetric pattern of a conductive mesh on the dielectric substrate. The antenna is preferably part of a cellular or cordless telephone handset.

32 Claims, 3 Drawing Sheets

PRINTED CONDUCTIVE MESH DIPOLE ANTENNA AND METHOD

BACKGROUND OF THE INVENTION

I. Field of the Invention

The present invention is directed generally to a method and apparatus for transmitting and receiving electromagnetic signals and, more particularly, to a printed conductive mesh dipole antenna and a method of transmitting and receiving signals using a printed conductive mesh dipole antenna.

II. Description of the Background

The use of cordless and cellular telephones is increasing exponentially in modem society. However, the large size of early handsets for use in such telephone systems made portability of the handsets, over short or long distances, cumbersome, and, in some cases, physically taxing. Additionally, storage of larger handsets is difficult, as such handsets do not fit into pockets, purses, wallets, or similar spaces.

As the size of handsets has been decreased, those handsets have become more portable and easier to store. However, the antennae necessary to the operation of those handsets still provides an impediment to portability and storability. Additionally, antennae could be easily broken if they extend too far to be easily stored or carried. Prior art attempts to decrease the size of the antenna used with handsets have typically led to a corresponding decrease in the performance of the antenna, and, thus, of the handset. Antennae printed on printed circuit boards have helped alleviate both problems, providing improved performance and smaller size, but such antennae still have a finite length to which they can be reduced while still retaining adequate performance characteristics.

Therefore, the need exists for an antenna for use with telephone handsets that provides a decrease in size, and thus provides ease in portability and storability, without a sacrifice in antenna performance.

BRIEF SUMMARY OF THE INVENTION

The present invention is directed to a printed dipole antenna. The printed dipole antenna includes a dielectric substrate and a conductive mesh formed of a plurality of symmetric shapes printed on the dielectric substrate. Each of the plurality of symmetric shapes is coupled to at least one other of the plurality of symmetric shapes. Each of the symmetric shapes is placed periodically on the dielectric substrate proximate to at least one other of the plurality of symmetric shapes, thereby allowing a coupling between the symmetric shapes. The periodic placement of the symmetric shapes forms a symmetric pattern of a conductive mesh on the dielectric substrate.

The present invention also includes a method of transmitting and receiving signals using a dipole antenna. The method includes providing a dielectric substrate, printing on the dielectric substrate a plurality of symmetric shapes into a conductive mesh formed of a symmetric placement of the shapes into a periodic pattern, coupling each of the shapes to at least one adjacent shape.

In transmit mode, the method continues with feeding a transmitted signal to the conductive mesh from a coupled transceiver, passing the transmitted signal through at least a portion of the conductive mesh, and transmitting the transmitted signal at the conductive mesh.

In receive mode, the method continues with receiving at least one signal at the conductive mesh, passing the received signal through at least a portion of the conductive mesh, and feeding the received signal from the conductive mesh to a coupled transceiver. The coupled transceiver is preferably a cellular or cordless telephone handset.

The present invention solves problems experienced with the prior art because the present invention provides an antenna and a method for use with a telephone handset that provides a decrease in size, and thus provides ease in portability and storability, without a sacrifice in antenna performance. The decrease in size is provided through a decrease in physical length of the antenna through the use of the conductive mesh. This invention uses the zigzag of the current to achieve the reduction of the physical size of the antenna. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical antenna and telephone system. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
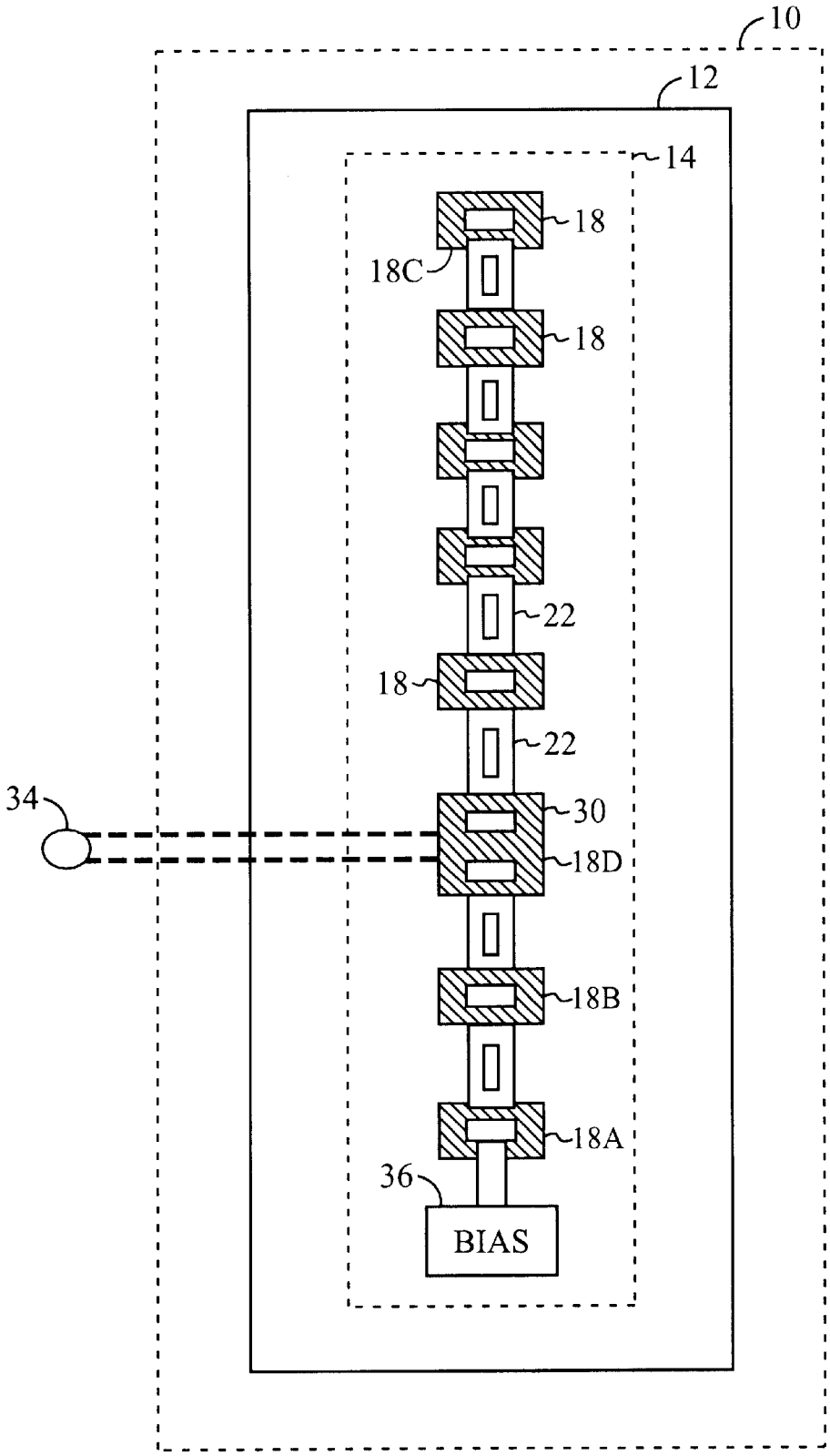
FIG. 1 is a top view of a printed dipole antenna.

FIG. 1 is a top view of a printed dipole antenna 10. The printed dipole antenna 10 includes a dielectric substrate 12 and a conductive mesh 14 placed on the dielectric substrate, preferably by printing.

The dielectric substrate 12 can be of a type known in the art. The dielectric substrate may be formed of, for example FR4 fiberglass composite, or chloro-fluorotetraethelene (such as is sold under the name TEFLON). In a preferred embodiment of the present invention, the dielectric substrate 12 is a printed circuit board. The printed circuit board used as the dielectric substrate 12 may be, for example, an FR4 printed circuit board in the PCS band.

Figure 2:
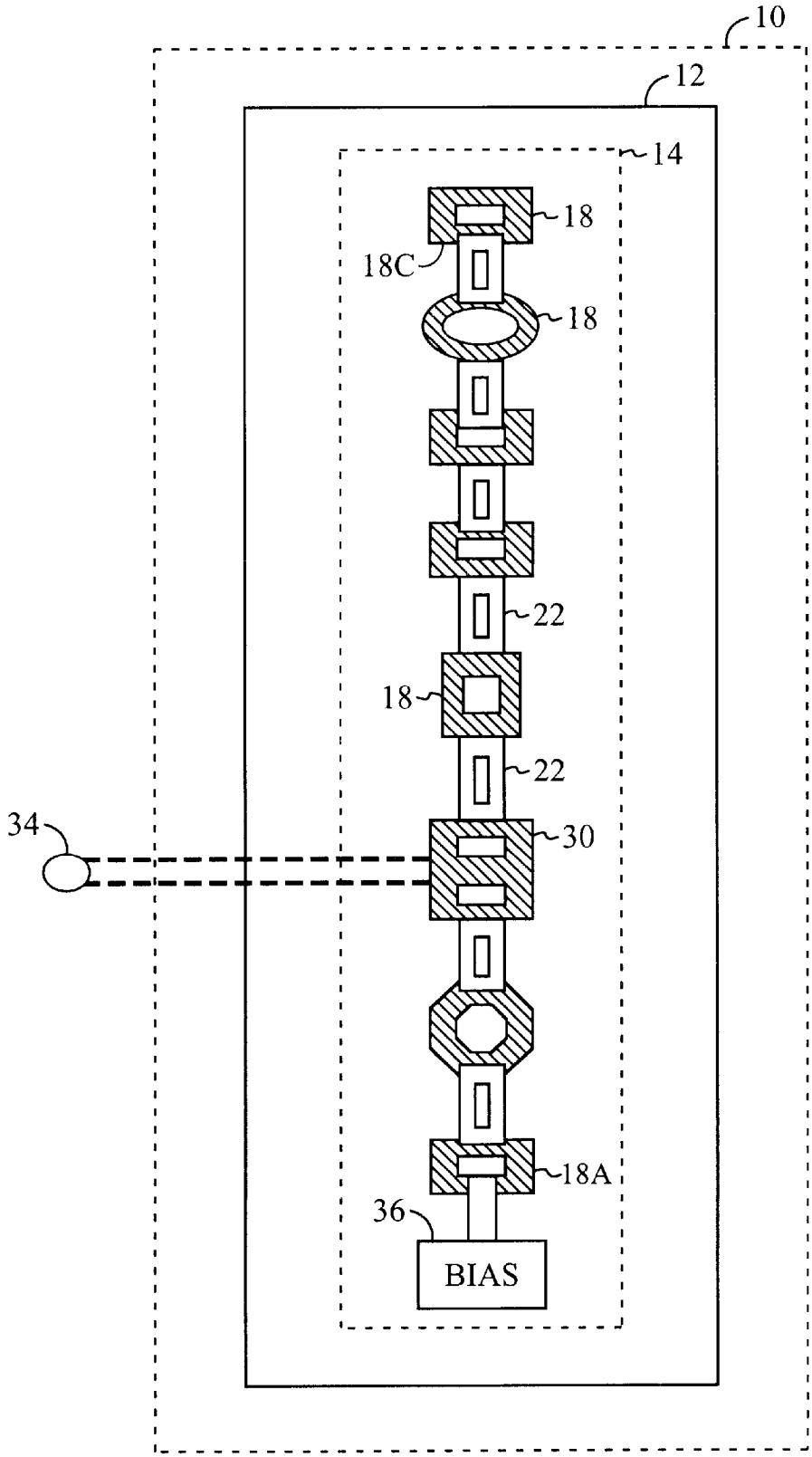
FIG. 2 is a top view illustrating an alternative embodiment of the printed dipole antenna of FIG. 1.

The conductive mesh 14 may be formed of any conductor known in the art to provide adequate conductivity for use in a telephone antenna application, such as copper, for example. The conductor 14 is printed onto the dielectric substrate 12 to form the conductive mesh 14. The conductive mesh 14 is formed of a plurality of symmetric shapes 18. In one embodiment, the symmetric shapes 18 are closed shapes, such as a circle, a square, a rectangle 18, or any polygon. The entire mesh 14 may be formed of one particular shape 18, such as the rectangles 18 shown in the figure, or may be a conglomeration of numerous different kinds of shapes 18 selected from a circle, square, rectangle 18, or polygon, such as the mesh shown in FIG. 2. The conglomeration may follow a set pattern, or a random pattern.

Each of the plurality of symmetric shapes 18 is coupled to at least one of the other symmetric shapes 18. In a preferred embodiment, each symmetric shape 18A is coupled to the nearest adjacent symmetric shape 18B. Thus, in a preferred embodiment, each of the two symmetric shapes 18A, 18C at the two ends of the dipole will be coupled only to one adjacent symmetric shape 18B, while each intermediate symmetric shape 18B between the two end symmetric shapes 18A, 18C is coupled to the two symmetric shapes 18A, 18D on either side of that intermediate symmetric shape 18B. This coupling 22 is performed by a periodic placement on the dielectric substrate 12 of each shape 18. The periodic placement is preferably as close together as possible, thereby minimizing the space taken up by the printed dipole 10. However, the space between the shapes 18 is subject to design considerations known to those in the art, such as interference patterns and cross-coupling.

The coupling 22 discussed hereinabove may be performed by methods known in the art. For example, each of the plurality of symmetric shapes 18 may be directly electrically connected, via at least one conductive strip 22, to at least one adjacent shape 18, wherein each shape 18 is placed for coupling 22 as discussed hereinabove. In an embodiment wherein adjacent shapes 18 are directly electrically connected by one conductive strip 22, it is preferred that the strip 22 be centered at the meeting point 26 of the strip 22 and the shape 18, with respect to at least one of the two shapes 18 coupled by the coupler 22. Further, the strip 22 may be centered with respect to both shapes 18 which meet at the coupler 22, or with respect to all shapes 18 that meet at a given coupler in embodiments wherein more than two shapes 18 meet at a given coupler 22. In an alternative embodiment, each of the plurality of symmetric shapes 18 may be coupled by an electromagnetic connection 22 to at least one adjacent shape 18. The conductive mesh preferably also includes a bias 36 coupled to the remainder of mesh 14. In a preferred embodiment, the periodic placement of the coupled shapes 18 forms a symmetric pattern, such as, but not limited to, the linear alignment shown in FIG. 1. The conductive mesh 14 is connected to a signal feed 30 located on the dielectric substrate 12.

In receive mode, the signal feed 30 passes the signal received at the dielectric substrate 12 from the mesh 14 to a transceiver 34. In transmit mode, the signal feed 30 passes the signal to be transmitted to the dielectric substrate 12 to the mesh 14 from transceiver 34. The signal, upon reaching the transceiver 34 (receive mode) or dielectric substrate 12 (transmit mode), has traversed a longer electrical space over a smaller physical length than a conventional printed dipole. It does so because the physical area has been provided with a smaller length through the use of the conductive mesh 14, thereby decreasing the necessary physical length of the antenna. In an exemplary embodiment, the electrical length of the antenna, which is the path traveled by a signal, may be in the range of 2.5 inches (6.2 cm) on a 62 mil FR4 board in the PCS band (1.9 GHz), while the actual length of the dipole antenna may be in the range of only 2.2 to 1.7 inches (5.6 to 4.3 cm) on a 562 mil FR4 board. This is an astonishing reduction of physical length without reduction of electrical length.

In the preferred embodiment of the present invention, the transceiver 34 is a telephone handset, such as a cordless telephone handset or a cellular telephone handset. The signal received at the telephone handset may be principally dependent on the signal received by the dipole antenna 10. Consequently, the bandwidth of the dipole antenna 10 of the present invention may be used to set the bandwidth for a telephone handset using the present invention.

Figure 3:
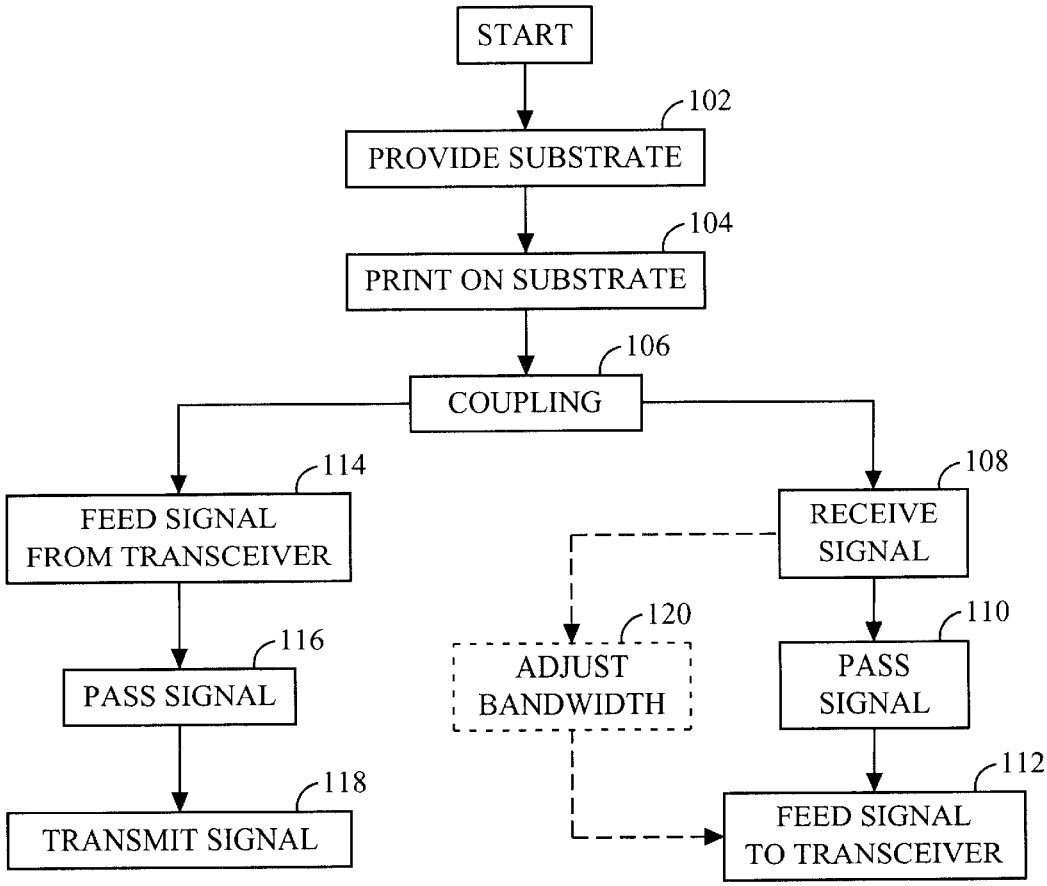
FIG. 3 is a block diagram illustrating a method of transmitting or receiving signals using a printed dipole antenna.

FIG. 3 is a block diagram illustrating a method of transmitting or receiving signals using a printed dipole antenna 100. The method 100 includes the steps of providing a dielectric substrate 102, printing on the dielectric substrate 104 a plurality of symmetric shapes into a conductive mesh formed of a symmetric placement of the shapes into a periodic pattern, coupling each of the shapes to at least one adjacent shape 106.

In receive mode, the method continues with receiving at least one signal 108 at the conductive mesh, passing the received signal 110 through at least a portion of the conductive mesh, and feeding the received signal from the conductive mesh to a coupled transceiver 112. In transmit mode, the method continues with feeding a to-be-transmitted signal 114 to the conductive mesh from a coupled transceiver, passing the to-be-transmitted signal 116 through at lest a portion of the conductive mesh, and transmitting the to-be-transmitted signal at the conductive mesh 118.

Printing step 104 may include printing the plurality of symmetric shapes as closed shapes. These closed shapes may include circles, squares, rectangles, or polygons, and the conductive mesh may be entirely formed of one shape, or may be a combination of two or more shapes in a set pattern or in a random pattern. Further, the printing 104 may be of any conductive material, such as, but not limited to, copper, gold, or aluminum. The thickness of the printing of the conductive material may be in the range of 0.7 mm. Printing of such materials on a dielectric substrate is well known in the art.

Coupling step 106 may include electromagnetically connecting each of the plurality of symmetric shapes to the least one adjacent one of the plurality of symmetric shapes, or directly electrically connecting each of the plurality of symmetric shapes to at least one adjacent one of the plurality of symmetric shapes. The direct electrical connecting step preferably includes printing at least one conductive strip onto the dielectric substrate between adjacent shapes.

In an alternative embodiment, the method may also include the step of controlling the bandwidth of the coupled transceiver 20 using the received signal fed from the conductive mesh to the coupled transceiver.

Those of ordinary skill in the art will recognize that many modifications and variations of the present invention may be implemented. The foregoing description and the following claims are intended to cover all such modifications and variations.

What is claimed is:

1. A dipole antenna, comprising:

a dielectric substrate; and a conductive mesh formed of a plurality of symmetric shapes printed on said dielectric substrate, each of the symmetric shapes being separated from other symmetric shapes;

wherein each of said plurality of symmetric shapes is coupled to at least one other of said plurality of symmetric shapes through at least one conductive strip.

2. The dipole antenna of claim 1, wherein the symmetric shapes are closed shapes.

3. The dipole antenna of claim 2, wherein the closed symmetric shapes are selected from the group consisting of a circle, a square and a rectangle.

4. The dipole antenna of claim 2, wherein the closed symmetric shapes are selected from at least two of the group consisting of a circle, a square and a rectangle.

5. The dipole antenna of claim 2, wherein the closed symmetric shapes comprise at least one circle and at least one polygon.

6. The dipole antenna of claim 2, wherein the closed symmetric shapes are polygons.

7. The dipole antenna of claim 1, wherein each of said plurality of symmetric shapes is directly electrically connected to at least one adjacent one of said plurality of symmetric shapes by one conductive strip, and wherein said conductive strip is centered with respect to at least one of the at least two connected symmetric shapes.

8. The dipole antenna of claim 1, wherein each of said plurality of symmetric shapes is electromagnetically connected to at least one adjacent one of said plurality of symmetric shapes.

9. The dipole antenna of claim 1, wherein the dipole antenna is communicatively connected to a telephone handset.

10. The dipole antenna of claim 9, wherein the telephone handset is a cellular telephone handset.

11. The dipole antenna of claim 9, wherein the dipole antenna sets a bandwidth for the telephone handset.

12. The dipole antenna of claim 1, wherein said conductive mesh comprises a printed circuit.

13. The dipole antenna of claim 12, wherein said dielectric substrate is a printed circuit board.

14. The dipole antenna of claim 13, wherein said dielectric substrate is an FR4 printed circuit board.

15. The dipole antenna of claim 13, wherein said dielectric substrate is a PCS band printed circuit board.

16. The dipole antenna of claim 1, wherein at least one of said plurality of symmetric shapes is directly electrically connected to a signal feed.

17. The dipole antenna of claim 1, wherein each of said symmetric shapes is placed periodically on said dielectric substrate proximate to at least one other of said plurality of symmetric shapes, and wherein the periodic placement forms a symmetric pattern of said plurality symmetric shapes.

18. A method of receiving signals using a dipole antenna, comprising:

providing a dielectric substrate;

printing on the dielectric substrate a plurality of symmetric shapes into a conductive mesh formed of a symmetric placement of the shapes into a periodic pattern, each of the symmetric shapes being separated from other symmetric shapes;

coupling each of the shapes to at least one adjacent shape through at least one conductive strip;

receiving at least one signal at the conductive mesh;

passing the received signal through at least a portion of the conductive mesh; and feeding the received signal from the conductive mesh to a coupled transceiver.

19. A method of transmitting signals using a dipole antenna, comprising:

providing a dielectric substrate;

printing on the dielectric substrate a plurality of symmetric shapes into a conductive mesh formed of a symmetric placement of the shapes into a periodic pattern, each of the symmetric shapes being separated from other adjacent shapes;

coupling each of the shapes to at least one adjacent shape through at least one conductive strip;

feeding a transmitting signal to the conductive mesh from a coupled transceiver;

passing the transmitted signal through at least a portion of the conductive mesh; and transmitting the transmitted signal at the conductive mesh.

20. The method of claim 18 or claim 19, wherein said printing comprises printing a plurality of closed symmetric shapes into a conductive mesh.

21. The method of claim 20, wherein said printing comprises printing a plurality of closed shapes, wherein at least one closed shape is selected from the group consisting of a circle and a polygon.

22. The method of claim 20, wherein said printing comprises printing a plurality of closed shapes, wherein at least one closed shape is selected from the group consisting of a circle and a polygon.

23. The method of claim 18 or claim 19, wherein said coupling comprises electromagnetically connecting each of the plurality of symmetric shapes to at least one adjacent one of the plurality of symmetric shapes.

24. The method of claim 18 or claim 19, wherein said coupling comprises directly electrically connecting each of the plurality of symmetric shapes to at least one adjacent one of the plurality of symmetric shapes.

25. The method of claim 24, wherein said directly electrically connecting comprises printing at least one conductive strip between at least two adjacent ones of the plurality of symmetric shapes, which conductive strip electrically contacts the at least two adjacent ones.

26. The method of either claim 18 or claim 19, wherein said printing comprises copper printing.

27. The method of claim 18 or claim 19, further comprising controlling a bandwidth of the coupled transceiver using the received signal fed from the conductive mesh to the coupled transceiver.

28. The method of either claim 19 or claim 20, wherein said printing comprises printing a plurality of closed symmetric shapes into a conductive mesh.

29. The method of either claim 18 or claim 19, wherein said coupling comprises electromagnetically connecting each of the plurality of symmetric shapes to at least one adjacent one of the plurality of symmetric shapes.

30. The method of either claim 18 or claim 19, wherein said coupling comprises directly electrically connecting each of the plurality of symmetric shapes to at least one adjacent one of the plurality of symmetric shapes.

31. The method of either claim 18 or claim 19, wherein said printing comprises copper printing.

32. The method of either claim 18 or claim 19, further comprising controlling a bandwith of the coupled transceiver using the received signal fed from the conductive mesh to the coupled transceiver.

* * * * *